US005924621A

United States Patent [19]

Hung

[11] Patent Number: 5,924,621

[45] Date of Patent: Jul. 20, 1999

[54] PNEUMATIC DRIVING SYSTEM FOR STAPLER

[75] Inventor: Sunking Hung, Taichung, Taiwan

[73] Assignee: Basso Industry Corp., Taichung, Taiwan

[21] Appl. No.: 09/184,162

[22] Filed: Nov. 2, 1998

[51] Int. Cl.[6] ..... B25C 1/04

[52] U.S. Cl. ..... 227/130; 227/8

[58] Field of Search ..... 227/130, 120, 227/8

[56] References Cited

U.S. PATENT DOCUMENTS

| | | | |
|---|---|---|---|
| 5,083,694 | 1/1992 | Lemos | 227/130 |
| 5,551,621 | 9/1996 | Vallee | 227/130 |
| 5,669,541 | 9/1997 | Ronconi | 227/130 |
| 5,791,545 | 8/1998 | Lin | 227/130 |
| 5,836,501 | 11/1998 | Lai | 227/130 |

*Primary Examiner*—Scott A. Smith
*Attorney, Agent, or Firm*—Charles E. Baxley, Esq.

[57] ABSTRACT

A stapler includes a driving member slidably disposed in the front portion for driving the nails or the like and includes a chamber for receiving a base and a casing and includes a channel for allowing the air to be discharged to the rear portion of the stapler. A valve member is slidably received in the casing and is biased to engage with a valve seat of the stapler for blocking the pressurized air to drive the driving member. The base has an aperture for receiving the pressurized air and for allowing the pressurized air to balance the valve member. The pressurized air in the casing is allowed to flow out of the stapler for allowing the valve member to be forced away from the valve seat when a button is forced to block the aperture of the base.

6 Claims, 7 Drawing Sheets

PNEUMATIC DRIVING SYSTEM FOR STAPLER

BACKGROUND OF THE INVENTION

1. Field of the Invention

The present invention relates to a stapler, and more particularly to a stapler having a pneumatic driving system.

2. Description of the Prior Art

Typical staplers comprise an inlet coupled to a pressurized air source for allowing the pressurized air to actuate the staplers. However, after the striking or the stapling operation, the pressurized air for driving the driving element may flow directly out from the front portion of the stapler and may flow to the operators. The dirt and oil may be also blown to the operators when the working environment is dirt.

The present invention has arisen to mitigate and/or obviate the afore-described disadvantages of the conventional staplers.

SUMMARY OF THE INVENTION

The primary objective of the present invention is to provide a stapler including a pneumatic driving system having a guide passageway for guiding the discharged air to flow out via the rear portion of the stapler and to prevent the air from flowing toward the operators.

The other objective of the present invention is to provide a stapler which includes a safety mechanism for preventing the pneumatic driving system from being operated inadvertently.

In accordance with one aspect of the invention, there is provided a stapler comprising a body including a front portion having a driving member slidably provided therein, and including a rear portion, and including a chamber formed therein and communicating with the front portion of the body, and including a passage formed therein and having a first end for coupling to a pressurized air source and having a second end communicating with the chamber for supplying the pressurized air to the front portion of the body via the chamber, the body including a first valve seat formed therein and provided between the chamber and the passage, the body including a channel formed therein and having a first end communicating with the chamber and having a second end open to the rear portion of the body, a base and a casing disposed in the chamber, the base including a cavity and an aperture formed therein and communicating with each other and including at least one orifice formed therein for communicating the chamber with an environment, the aperture being coupled to the passage for receiving the pressurized air, the base including a second valve seat provided therein, the casing including an interior formed therein and communicating with the front portion of the body and including at least one hole formed therein for communicating the interior of the casing and the channel with the front portion of the body, a button slidably received in the body, means for forcing the button to engage with the second valve seat and to block the aperture, the pressurized air in the aperture being blocked and being prevented from flowing into the casing via the at least one orifice of the base when the button is forced to engage with the second valve seat, the pressurized air in the aperture being allowed to flow into the casing via the at least one orifice of the base when the button is disengaged from the second valve seat, a valve member slidably received in the casing, and means for biasing the valve member to engage with the first valve seat, the pressurized air in the passage being blocked and prevented from flowing into the front portion of the body when the valve member is forced to engage with the first valve seat of the body. The valve member is biased to engage with the first valve seat when the button is not forced to engage with the second valve seat, and the valve member is forced away from the first valve seat when the button is forced to engage with the second valve seat.

The body includes a throughway formed therein for coupling the passage to the aperture and for allowing the pressurized air in the passage to flow into the cavity via the aperture. The base includes a cylindrical member provided therein for defining the cavity. The valve member includes a plug slidably engaged in the casing, and means for making an air tight seal between the plug of the valve member and the casing.

A cap is secured to the body and includes a puncture formed therein for slidably receiving the button, and means for biasing the button to engage with the cap and to enclose the puncture of the cap, the pressurized air in the cavity of the base is prevented to flow out of the body when the button is forced to engage with the cap. The cap includes a hook for hooking to the body and for attaching the cap to the body, and means for securing the cap to the body.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
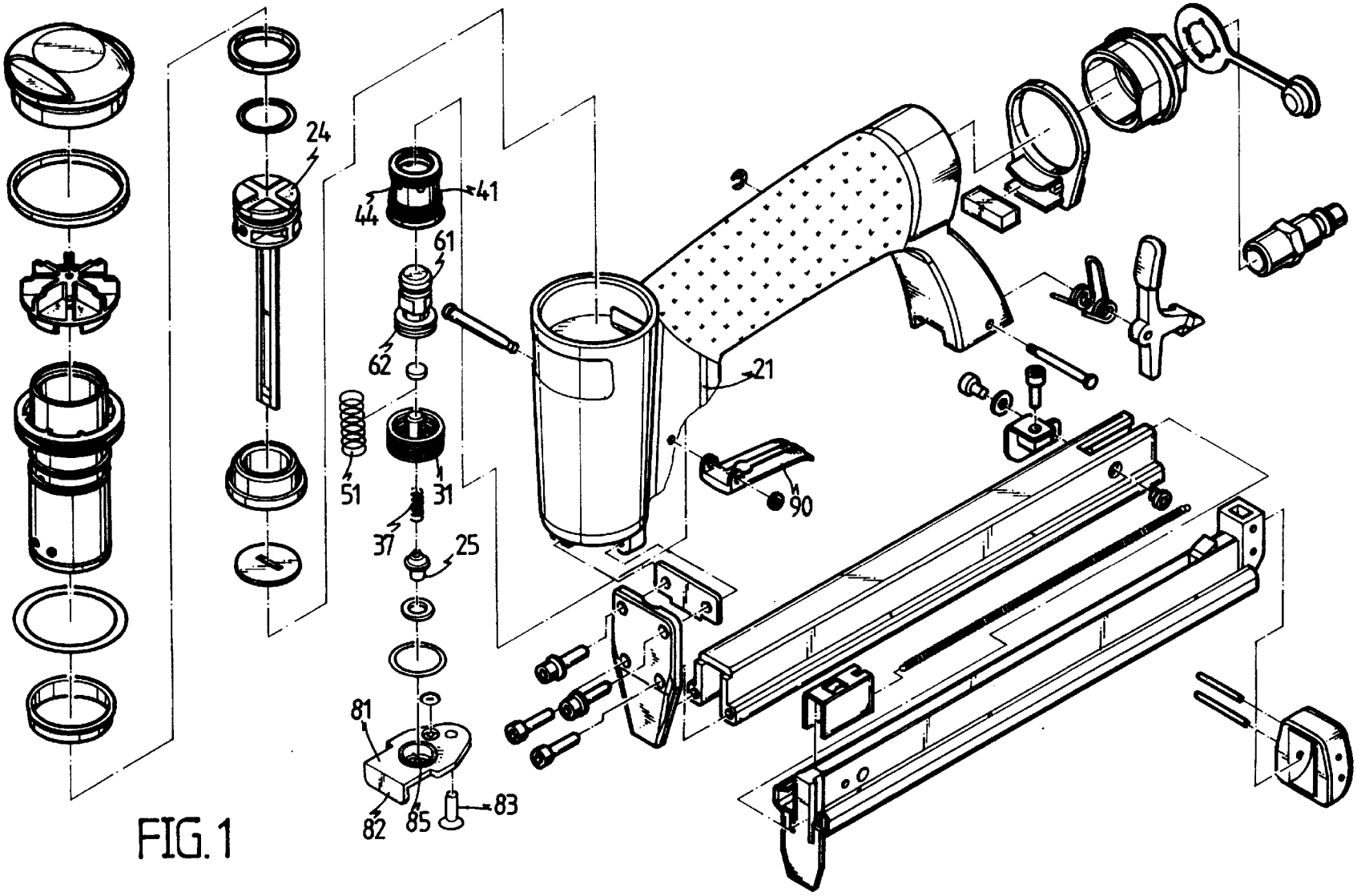
FIG. 1 is an exploded view of a stapler in accordance with the present invention.
Figure 2:
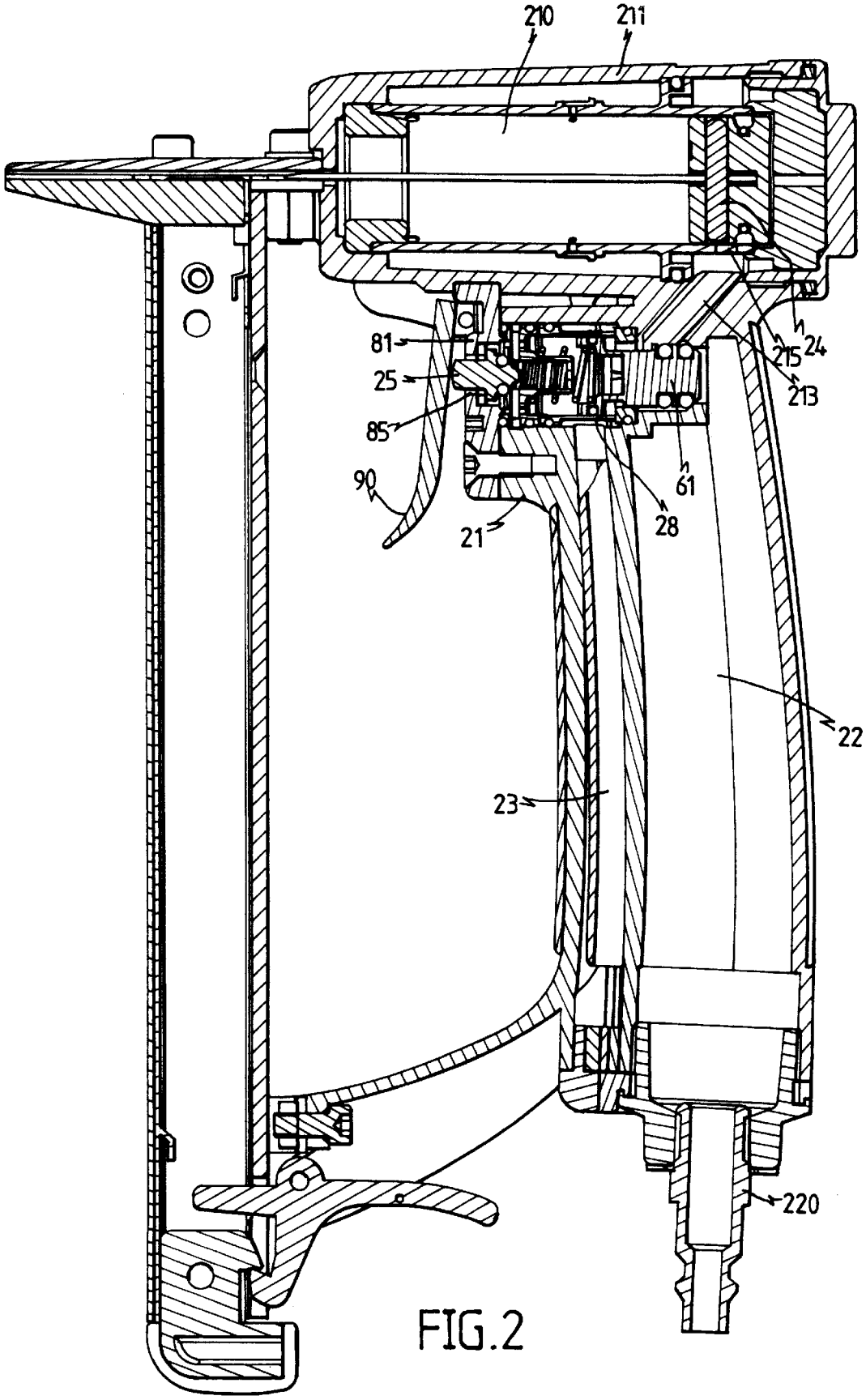
FIG. 2 is a cross sectional view of the stapler.
Figure 3:
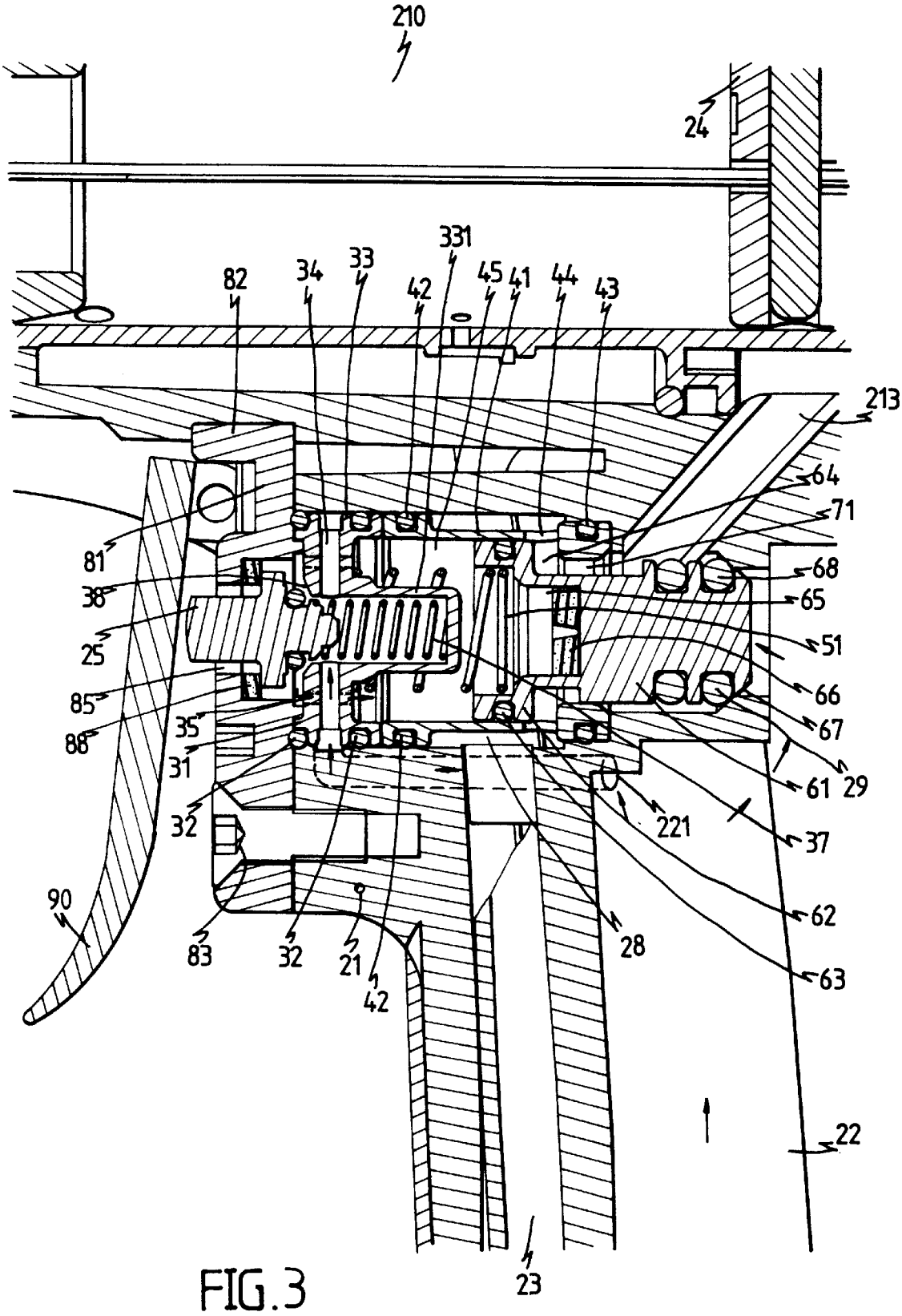
FIGS. 3 and 4 are enlarged partial cross sectional views illustrating the operation of the stapler.

Referring to the drawings, and initially to FIGS. 1–3, a stapler in accordance with the present invention comprises a space 210 formed in a front portion 211 of the stapler body 21 for slidably receiving a driving member 24 which may be used for striking or for actuating the nails or the like. The body 21 includes a chamber 28 formed in the front portion close to the front portion 211 and includes a passage 22 having a rear portion coupled to a pressurized air source via a coupler 220 and having a front portion communicating with the chamber 28. A valve seat 29 is formed in the front portion of the body 21 and located between the chamber 28 and the passage 22. The body 21 includes a channel 23 formed therein and substantially parallel to the passage 22 and having a front end communicating with the chamber 28 and having a rear end open to the rear end of the body 21 for discharging the pressurized air after the striking or the stapling operation.

Figure 4:
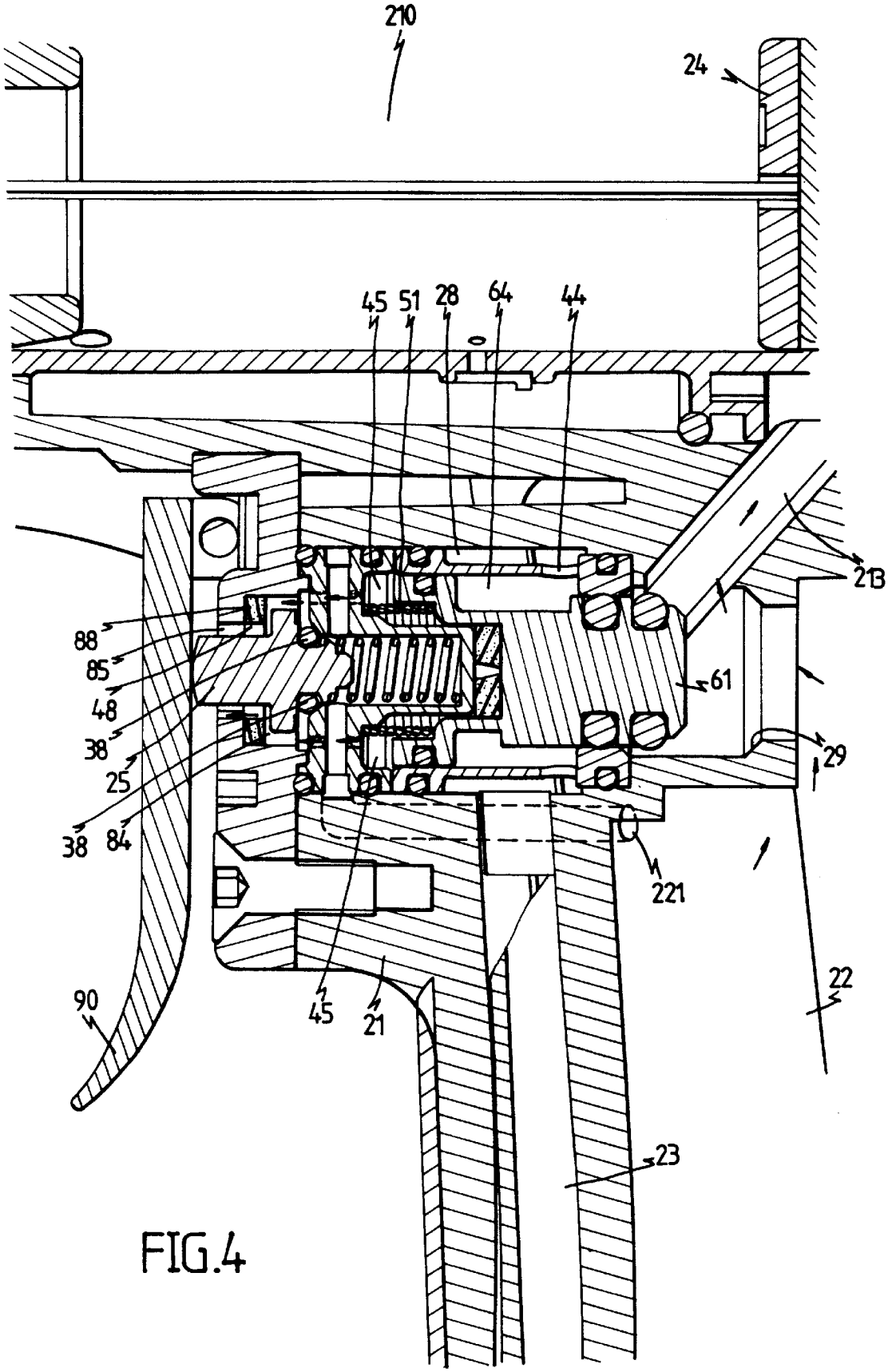
Figure 5:
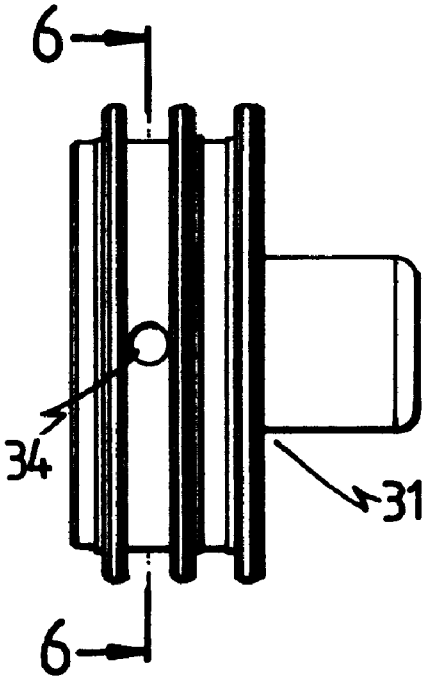
FIG. 5 is a side view of a base that is disposed in the stapler.
Figure 6:
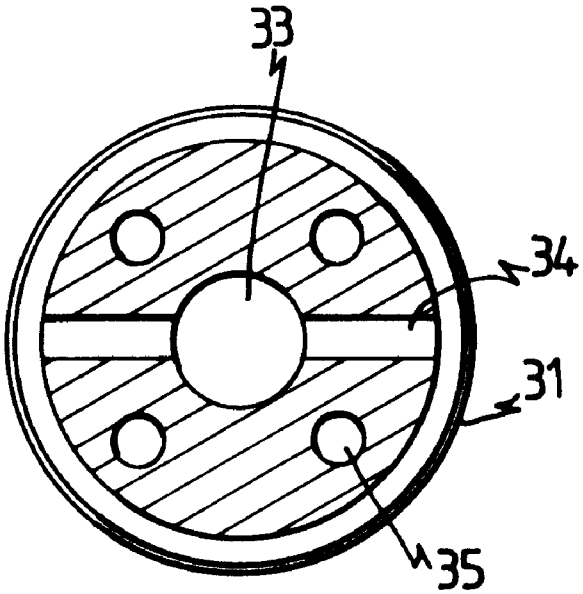
FIG. 6 is a cross sectional view taken along lines 6—6 of FIG. 5.
Figure 8:
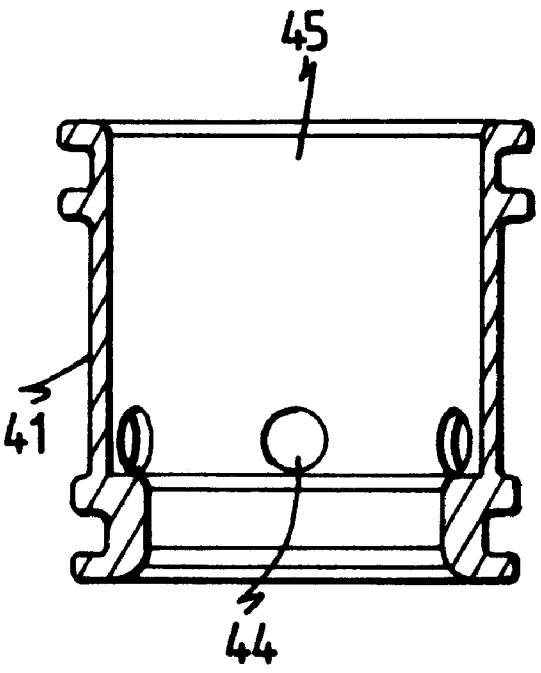
FIG. 8 is a cross sectional view taken along lines 8—8 of FIG. 7.
Figure 7:
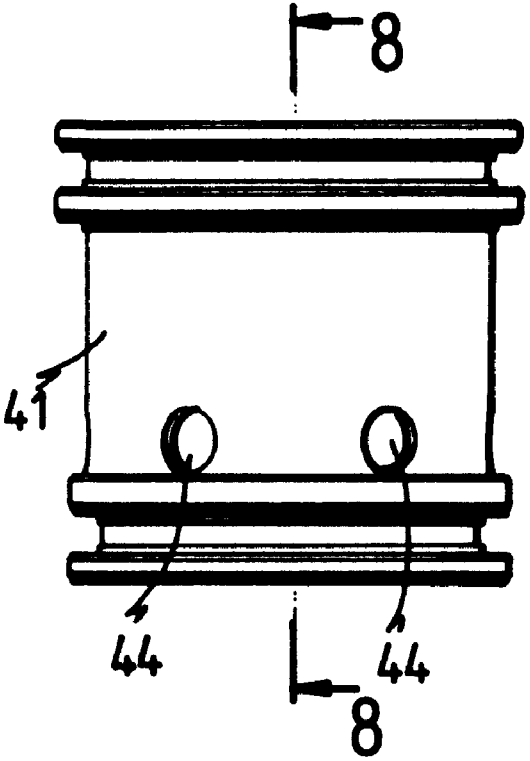
FIG. 7 is a side view of a casing that is disposed in the stapler and is engaged on the base.
Figure 9:
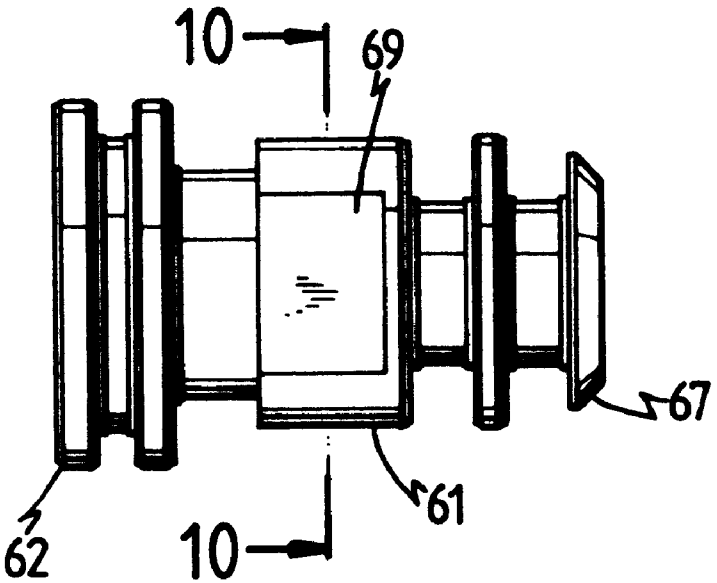
FIG. 9 is a side view of a valve member that is slidably received in the casing.
Figure 10:
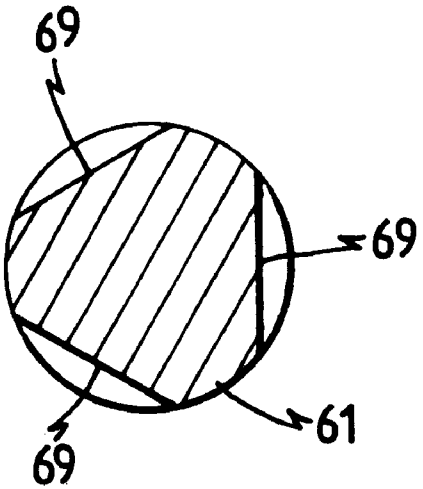
FIG. 10 is a cross sectional view taken along lines 10—10 of FIG. 9.

As shown in FIGS. 5–8 and referring to FIGS. 3 and 4, a base 31 and a casing 41 are disposed in the chamber 28. The base 31 (FIGS. 5, 6) includes a cavity 33 formed by a cylindrical member 331, and includes an aperture 34 laterally formed therein and communicating with the cavity 33, and includes a number of orifices 35 formed through the base 31 and parallel to the cavity 33. The orifices 35 are not communicated with the aperture 34 and the cavity 33. The base 31 includes a valve seat 38 (FIGS. 3, 4) formed therein and facing away from the casing 41. Two sealing rings 32 are engaged between the body 21 and the base 31 for making an air tight seal between the base 31 and the body 21. The casing 41 includes an interior 45 communicating with the orifices 35 and includes two sealing rings 42, 43 engaged between the body 21 and the casing 41 for making an air tight seal between the casing 41 and the body 21. The casing 41 includes a number of holes 44 formed therein (FIGS. 7, 8) for communicating the interior 45 of the casing 41 with the channel 23. The body 21 includes a guideway 213 and a puncture 215 formed therein (FIG. 2) for communicating the interior 45 of the casing 41 with the space 210 and for allowing the air in the space 210 to be forced to flow outward of the rear portion of the body 21 via the puncture 215 and the guideway 213 and the interior 45 of the chamber 41 and the holes 44 and the channel 23 when the driving member 24 is recovered to the original positoin after the stapling operation.

As best shown in FIG. 3, the aperture 34 has one end communicating with the passage 22 via a throughway 221 (FIGS. 3, 4) for allowing the pressurized air from the passage 22 to flow into the cavity 33 via the aperture 34 and to flow into the interior 45 of the casing 41 via the orifices 35 of the base 31. A button 25 is slidably received in the body 21 and and a trigger 90 is rotatably secured to the body 21 for actuating the button 25 to engage with the valve seat 38 (FIG. 4) and for enclosing the cavity 33 of the base 31 and for preventing the air in the cavity 33 to flow into the interior 45 of the casing 41 via the orifices 35. A cap 81 includes a hook 82 for hooking to the body 21 and is secured to the body 21 by one or more fasteners 83 for stably retaining the button 25 in place. The cap 81 includes a puncture 85 for slidably receiving the button 25. A gasket 88 may be provided for engaging with the button 25 and for cushioning the button 25. A spring 37 is received in the cavity 33 of the base 31 and engaged with the button 25 for biasing the button 25 to engage with the gasket 88 and to enclose the puncture 85. The button 25 may be forced and moved against the spring 37 by the trigger 90.

As shown in FIGS. 3, 4 and 9, 10, a valve member 61 is slidably received in the casing 41 and a spring 51 is engaged between the valve member 61 and the base 31 for biasing the tapered surface 67 and/or the sealing ring 68 of the valve member 61 to engage with the valve seat 29 of the body 21 (FIG. 3) and for preventing the air from flowing toward the driving member 24 via the guideway 213. The valve member 61 includes a plug 62 having a space 65 formed therein for receiving a gasket 66 which is provided for engaging with the cylindrical member 331 of the base 31 (FIG. 4) and for cushioning the base 31 and the valve member 61, and includes a sealing ring 63 engaged between the valve member 61 and the casing 41 for making an air tight seal between the valve member 61 and the casing 41. The valve member 61 includes one or more cut off portions or notches 69 (FIG. 10) for defining a throughway 71 (FIG. 3) between the casing 41 and the valve member 61. A space 64 is formed between the valve member 61 and the casing 41 and communicating with the throughway 71.

In operation, as shown in FIG. 3, when the button 25 is not actuated, the tapered surface 67 and/or the sealing ring 68 of the valve member 61 is biased to engage with the valve seat 29 by the spring 51 such that the pressurized air may not flow to drive the driving member 24. The pressurized air from the passage 22 may flow into the aperture 34 and the cavity 33 via the throughway 221 of the body 21 and may flow into the interior 45 of the casing 41 via the orifices 35 before the button 25 is actuated to engage with the valve seat 38 of the casing 31. The button 25 is biased to engage with the cap 81 at the gasket 88 and to enclose the puncture 85 for preventing the pressurized air from flowing out to the environment. At this moment, the air pressures in the casing 41 and in the passage 22 are balanced, such that the spring 51 may bias the valve member 61 to engage with the valve seat 29 and such that the pressurized air may not flow to actuate the driving member 24 at this moment. The driving member 24 thus will not be actuated inadvertently.

As shown in FIG. 4, when the button 25 is actuated to engage with the valve seat 38 of the base 31 by the trigger 90, the pressurized air from the passage 22 may flow into the cavity 33 only, the air may be blocked and may not flow into the casing 41 via the orifices 35. In addition, at this moment, a gap 84 (FIG. 4) is formed between the button 25 and the body 21 or the cap 90 such that the interior 45 of the casing 41 is communicated with the environment via the orifices 35 and the gap 84 and such that the pressure in the interior 45 of the casing 41 is greatly decreased. The pressurized air in the passage 22 may thus force the valve member 61 away from the valve seat 29 against the spring 51 and may flow to actuate the driving member 24 via the guideway 213 and the puncture 215 of the body 21 (FIG. 2). When the valve member 61 is recovered or biased to engage with the valve seat 29 again by the spring 51 after the stapling operation, the air in the space 210 of the body 21 and in the guideway 213 and the puncture 215 may be forced through the throughway 71 and the space 64 and the holes 44 and may thus flow to the rear portion of the body 21 via the channel 23. The outward flow of the air thus will not blow the dirt toward the operators.

Accordingly, the stapler in accordance with the present invention includes a pneumatic driving system having a guide passageway for guiding the discharged air to flow out via the rear portion of the stapler and to prevent the air from flowing toward the operators. The stapler further includes a safety mechanism for preventing the pneumatic driving system from being operated inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler comprising:

a body including a front portion having a driving member slidably provided therein, and including a rear portion, and including a chamber formed therein and communicating with said front portion of said body, and including a passage formed therein and having a first end for coupling to a pressurized air source and having a second end communicating with said chamber for supplying the pressurized air to said front portion of said body via said chamber, said body including a first valve seat formed therein and provided between said chamber and said passage, said body including a channel formed therein and having a first end communicating with said chamber and having a second end open to said rear portion of said body, a base and a casing disposed in said chamber, said base including a cavity and an aperture formed therein and communicating with each other and including at least one orifice formed therein for communicating said chamber with an environment, said aperture being coupled to said passage for receiving the pressurized air, said base including a second valve seat provided therein, said casing including an interior formed therein and communicating with said front portion of said body and including at least one hole formed therein for communicating said interior of said casing and said channel with said front portion of said body, a button slidably received in said body, means for forcing said button to engage with said second valve seat and to block said aperture, the pressurized air in said aperture being blocked and being prevented from flowing into said casing via said at least one orifice of said base when said button is forced to engage with said second valve seat, the pressurized air in said aperture being allowed to flow into said casing via said at least one orifice of said base when said button is disengaged from said second valve seat, a valve member slidably received in said casing, and means for biasing said valve member to engage with said first valve seat, the pressurized air in said passage being blocked and prevented from flowing into said front portion of said body when said valve member is forced to engage with said first valve seat of said body, said valve member being biased to engage with said first valve seat when said button is not forced to engage with said second valve seat, and said valve member being forced away from said first valve seat when said button is forced to engage with said second valve seat.

2. The stapler as claimed in claim 1, wherein said body includes a throughway formed therein for coupling said passage to said aperture and for allowing the pressurized air in said passage to flow into said cavity via said aperture.

3. The stapler as claimed in claim 1, wherein said base includes a cylindrical member provided therein for defining said cavity.

4. The stapler as claimed in claim 1, wherein said valve member includes a plug slidably engaged in said casing, and means for making an air tight seal between said plug of said valve member and said casing.

5. The stapler as claimed in claim 1 further comprising a cap secured to said body and including a puncture formed therein for slidably receiving said button, and means for biasing said button to engage with said cap and to enclose said puncture of said cap, the pressurized air in said cavity of said base being prevented to flow out of said body when said button is forced to engage with said cap.

6. The stapler as claimed in claim 5, wherein said cap includes a hook for hooking to said body and for attaching said cap to said body, and means for securing said cap to said body.

* * * * *